United States Patent [19]

Heinis et al.

[11] Patent Number: 4,792,236

[45] Date of Patent: Dec. 20, 1988

[54] MULTI-CANISTER TINTER WITH LOST-MOTION COUPLING

[75] Inventors: Robert Heinis, Totowa; James C. Skene, Old Bridge; Ronald Smith, Short Hill, all of N.J.

[73] Assignee: Red Devil, Inc., Union, N.J.

[21] Appl. No.: 52,381

[22] Filed: May 21, 1987

[51] Int. Cl.[4] ..... B01F 07/00

[52] U.S. Cl. ..... 366/245; 366/279; 366/297; 366/605; 366/241; 366/199

[58] Field of Search ..... 192/67 R, 108; 366/247, 366/160, 167, 168, 244, 245, 249, 261, 279, 347, 348, 349, 605, 150, 154, 155, 156, 176, 241, 242, 244, 605, 197, 199, 206, 297

[56] References Cited

U.S. PATENT DOCUMENTS

| | | | |
|---|---|---|---|
| 920,738 | 5/1909 | Hawes | 366/283 |
| 1,482,279 | 1/1924 | Trust et al. | 366/197 |
| 1,915,220 | 6/1933 | Fegley et al. | 366/283 |
| 2,736,535 | 2/1956 | Clark et al. | 366/282 |
| 2,905,451 | 9/1959 | Callanen et al. | 366/244 |
| 2,965,363 | 12/1960 | Worden | 366/197 |

FOREIGN PATENT DOCUMENTS 809346 7/1951 Fed. Rep. of Germany ..... 259/100

*Primary Examiner*—Philip R. Coe
*Assistant Examiner*—J. Dwight Poffenberger, Jr.
*Attorney, Agent, or Firm*—Thomas R. Morrison

[57] ABSTRACT

A paint tinter system includes a plurality of canisters disposed in a circle about a rotatable plate. An orbiting plate, driven by a single motor, is connected to drive arms, each of which is connected to a crank arm of a stirrer in one of the canisters. The connection is made through a lost-motion device in a cap covering each canister. The cap captures the end of the drive arm, whereby the cap may be removed and hinged out of the way for providing access to the canister. An impeller is freely mounted for rotation in a socket in the bottom of the canister. The upper end of the impeller is driven by engagement between a pair of driver bosses rotated by the crank and edges of a top plate on the canister. Thus, when the cover is removed, the impeller may remain unmoved or be lifted from the socket for cleaning.

4 Claims, 6 Drawing Sheets

MULTI-CANISTER TINTER WITH LOST-MOTION COUPLING

BACKGROUND OF THE INVENTION

The present invention relates to tinters and, more particularly, to multi-canister tinters having apparatus for stirring a tinter fluid in all of the canisters.

It is economical to manufacture paint in large quantities, all of the same color. Customers demand a variety of colors, usually in very small quantities. One solution to these conflicting requirements includes manufacturing a base-colored paint, usually white, and providing a plurality of differently colored tinter fluids at the point of sale. Recipes are provided relating quantities of one or more tinter fluids to a final mixed color. Custom mixing of a pigmented tinter fluid at the point of sale produce the final color desired by a customer. Accuracy in dispensing the tinter fluid is vital to attaining the desired color.

Tinter fluids contain a fluid carrier with a suspension of pigment dispersed therein. If not mixed on a regular basis, the pigment may settle to the bottom of the mixture. This produces different pigment densities at different depths in the mixture. Accordingly, a given quantity of tinter fluid from near the bottom of the mixture contains a greater amount of pigment than an equal quantity from near the top of the mixture. Furthermore, as tinter fluid is dispensed from the bottom of such a separated mixture, the density of pigment in the tinter fluid remaining in the mixture decreases. It is thus seen that it is important to provide a mechanism for stirring the tinter fluid.

One type of stirrer includes a crank handle accessible for manual actuation external to a tinter canister. An impeller stirs the tinter fluid within the canister.

One popular type of tinter dispenser system includes a plurality of tinters disposed in a circle on a rotatable plate. Twelve or more tinters are commonly employed. Manual stirring of so many tinters is generally not practical. One solution includes an electric motor mounted atop each tinter connected to drive an impeller within. The need for twelve or more motors, plus the wiring and control therefor, increases the cost of this solution.

U.S. Pat. No. 3,740,026, the disclosure of which is herein incorporated by reference, describes a multi-canister paint tinter in which impellers in all of a plurality of canisters are driven by a single motor. The motor drives a plate in an orbiting motion. Drive arms hinged to the plate are connected to ends of crank arms above the canisters. The crank arms are connected to shafts of impellers in the canisters. The connections between the crank arms and the drive arms permit the drive arms to be hinged out of the way for filling the canisters.

The apparatus of the above patent employs an impeller operatively connected to a cover of its canister. When the cover is removed, the impeller is removed with it. The tinter fluid within the canister is a viscous material having a high pigment content. Care must be taken to avoid staining items when the impeller, coated with tinter fluid, is removed with the cap. The ability to remove the impeller with the cap is useful in permitting cleaning of the interior of the canister.

Other tinters employ a stirrer having lower and upper bearings integral with the canister. Although this permits removal of the canister cap without removing the impeller, it makes it difficult to remove the impeller for cleaning prior to changing the color of the tinter fluid therein.

OBJECTS AND SUMMARY OF THE INVENTION

Accordingly, it is an object of the invention to provide a multi-canister tinter which overcomes the drawbacks of the prior art.

It is a further object of the invention to provide a multi-canister tinter wherein an impeller in a canister is driven through a lost-motion rotary coupling from a crank affixed in a canister cap. The lost-motion rotary coupling permits the cap to be removed independently of the impeller.

Briefly stated, the present invention provides a paint tinter system having a plurality of tinter canisters disposed in a circle about a rotatable plate. An orbiting plate, driven by a single motor, is connected to drive arms, each of which is connected to a crank arm of a stirrer in one of the canisters. The connection is made through a lost-motion device in a cap covering each canister. The cap captures the end of the drive arm, whereby the cap may be removed and hinged out of the way for providing access to the canister An impeller is freely mounted for rotation in a socket in the bottom of the canister. The upper end of the impeller is driven by engagement between grooves in a pair of driver bosses rotated by the crank. Thus, when the cover is removed, the impeller may remain in position or be lifted from the socket for cleaning.

According to an embodiment of the invention, there is provided a carousel paint tinter system comprising: a plate, a plurality of tinters disposed about a perimeter of the plate, a central portion of the plate being surrounded by the plurality of tinter, each of the tinters including a canister and a tinter pump, the canisters including first and second brace tabs on opposed sides thereof adjacent an upper end, the first brace tab of one canister overlapping and abutting the second brace tab of its neighboring canister, and means for rigidly affixing together all overlapping and abutting first and second brace tabs whereby a continuous ring of bracing is provided adjacent the upper ends.

According to a feature of the invention, there is provided a paint tinter system comprising: a canister, the canister including a socket centrally disposed in a bottom thereof, an impeller within the canister, the impeller including a boss fittable within the socket, the socket and the boss having dimensions and fit effective to support the impeller, a cap on the canister, a crank shaft centrally disposed in the cap, means for rotating the crank shaft, a plate affixed to the crank shaft, first and second driver bosses at opposed ends of the plate, each of the driver bosses including a groove therein facing in a direction of rotation of the plate, first and second pins extending from the impeller, and the first and second pins being disposed at a radius effective to engage the first and second grooves whereby a lost-motion connection is attained between the plate and the impeller.

According to a further feature of the invention, there is provided a paint tinter comprising: a plate, at least one tinter on the plate, the tinter including a canister, an impeller within the canister, a cap fittable onto an upper end of the canister, the cap including an inner member having a guide centrally disposed therein, a crank shaft rotatably fitted through the guide, a plate affixed at a lower end of the crank shaft, first and second means for lost-motion connection from first and second opposed ends of the plate to the impeller, a crank affixed to an upper end of the crank shaft, the plate and the crank shaft capturing the inner member therewith, a drive arm, means for connecting a first end of the drive arm to a distal end of the crank for providing rotation thereto, means for preventing disconnection of the means for connecting, whereby the inner member, the crank and the drive arm form a unitary assembly, and means for lost-motion connection between distal ends of the plate and the impeller.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
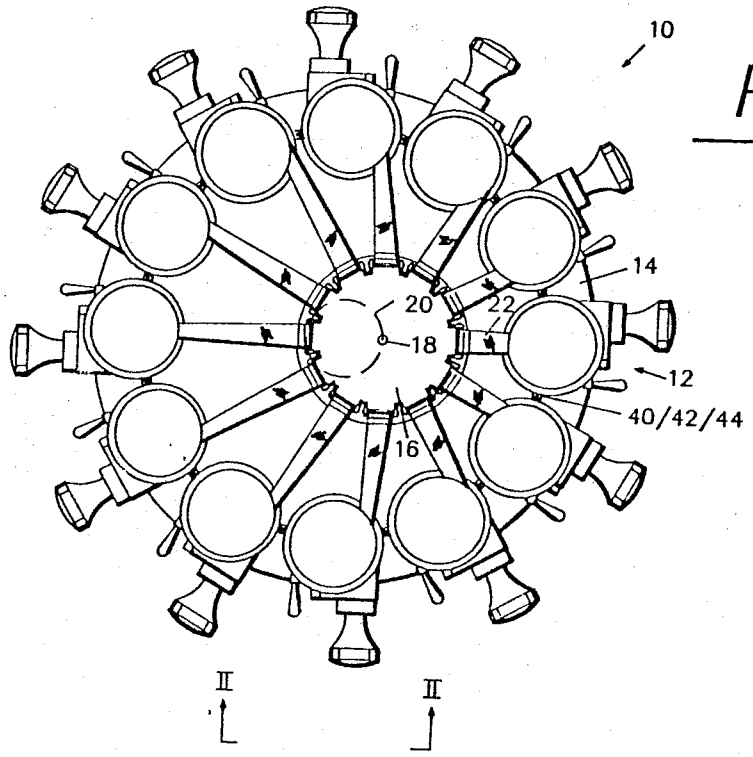
FIG. 1 is a top view of a multi-canister tinter having stirrers according to an embodiment of the invention.

Referring to FIG. 1, there is shown, generally at 10, a multi-canister tinter assembly according to an embodiment of the invention. A plurality of identical tinters 12 are disposed at equal angles about a perimeter of a rotary plate 14. In the illustrated embodiment, twelve tinters 12 are provided. More or less than twelve tinters 12 may be used. An orbit plate 16 is driven by an eccentric drive mechanism to move a center 18 in an orbiting motion as indicated by a dashed circle 20. The eccentric drive mechanism is assumed to be conventional and may be of the type disclose in the referenced patent. Thus, further description thereof is unnecessary.

A plurality of drive arms 22, equal in number to the number of tinters 12, are hingedly connected to a perimeter of orbit plate 16. A distal end of each of drive arms 22 is operatively connected to its respective tinter 12.

Figure 2:
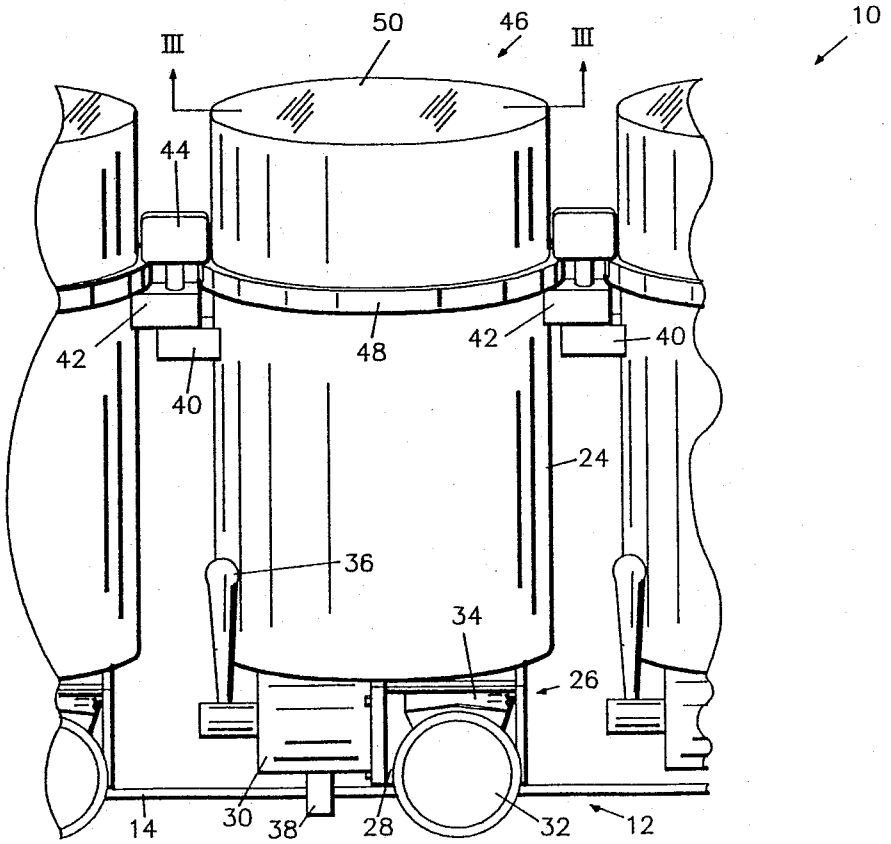
FIG. 2, is a view taken in the direction II—II in FIG. 1.

Referring now to FIG. 2, each tinter 12 includes a canister 24 having a tinter pump 26 associated therewith. Tinter pump 26 may be of any convenient type such as, for example, that disclosed or referenced in co-pending U.S. patent application Ser. No. 07/045,376 of common assignee with the present invention. As disclosed therein, tinter pump 26 includes a horizontal-acting displacement pump 28 and a two-way valve 30. In operation, a knob 32, controlling a dispensable amount of tinter fluid in a displacement chamber (not shown) is moved to a position guided by a scale 34. A handle 36 on two-way valve 30 is moved to its dispensing position and knob 32 is pushed to its home position. As knob 32 is pushed to its home position, the dispensable amount of tinter fluid is dispensed through an outlet 38.

The top of each tinter 12 is tied to its neighbor by brace tabs 40 and 42 engaged by a thumb screw 44. It will be noted that brace tabs 40 and 42 are disposed so that the upper surfaces of brace tab 40 abut the lower surfaces of their brace tabs 42. Referring momentarily to FIG. 1, the bracing provided by brace tabs 40 and 42 provide hoop strength by tying the tops of all tinters 12 together to form a closed circle.

A cap 46 atop each canister 24 includes a rim 48 and a cover 50. It will be noted that rim 48 has a diameter exceeding cover 50 to provide an abutment surface against which edges of thumb screw 44 may bear to hold cap 46 on place during operation. Although one skilled in the art would observe other ways of attaining engagement of thumb screw 44 with brace tabs 40 and 42, one o employs external threads on thumb screw 44 and complementary in a hole (not shown) in brace tab 40.

Figure 3:
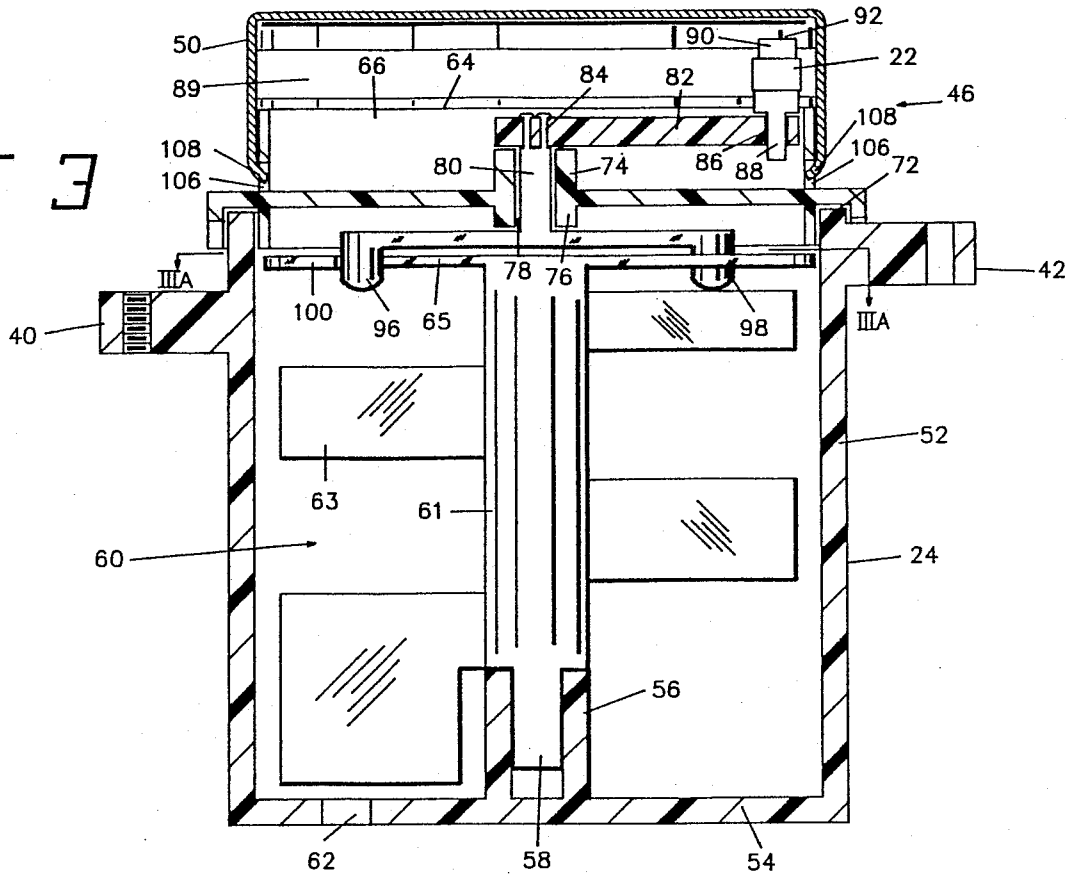
FIG. 3 is a cross section of a canister and cap of one of the tinters of FIGS. 1 and 2.

Referring now to FIG. 3, canister 24 includes an annular side wall 52 and a bottom 54. A socket 56 is centrally disposed in bottom 54 for receiving a boss 58 extending thereinto from an impeller 60. Impeller 60 includes a central vertical shaft 61 having a plurality of inclined vanes 63 extending horizontally therefrom at staggered locations along its length. A top bar 65 extends horizontally from vertical shaft 61 toward an inner surface of annular side wall 52. An opening 62 permits connection of tinter fluid from canister 24 to tinter pump 26 (FIG. 2).

An inner member 64 of cap 46 includes an annular wall 66 extending upward from a circular plate 68. Rim 48 extends outward from circular plate 68. A groove 70 in a lower surface of rim 48 embraces an upper end 72 of annular side wall 52.

An upper annular wall 74, centrally disposed in circular plate 68, is aligned with a lower annular wall 76 to provide a cylindrical guide 78 passing through the center of circular plate 68 A crank shaft 80 is connected at its upper end to one end of a crank 82. Connection between crank shaft 80 and crank 82 may employ any conventional technique such as cementing or welding but, in the preferred embodiment, one or more bosses 84 extend from an upper end of crank shaft 80 through mating holes in crank 82. Portions of bosses 84 extending beyond crank 82 are flattened to prevent withdrawal detachment. A hole 86 at an outer end of crank 82 is engaged by a pin 88 affixed to drive arm 22. A window 89 covering approximately 180 degrees of cover 50 permits entry of drive arm 22. A boss 90 atop drive arm 22 provides a clearance between an upper surface 92 thereof and an inner surface of cover 50 which is less than the length of pin 88. Thus, once assembled in the manner shown, it is not possible to disengage pin 88 from hole 86 because of the interference of upper surface 92 with the inner surface of cover 50.

Figure 3A:
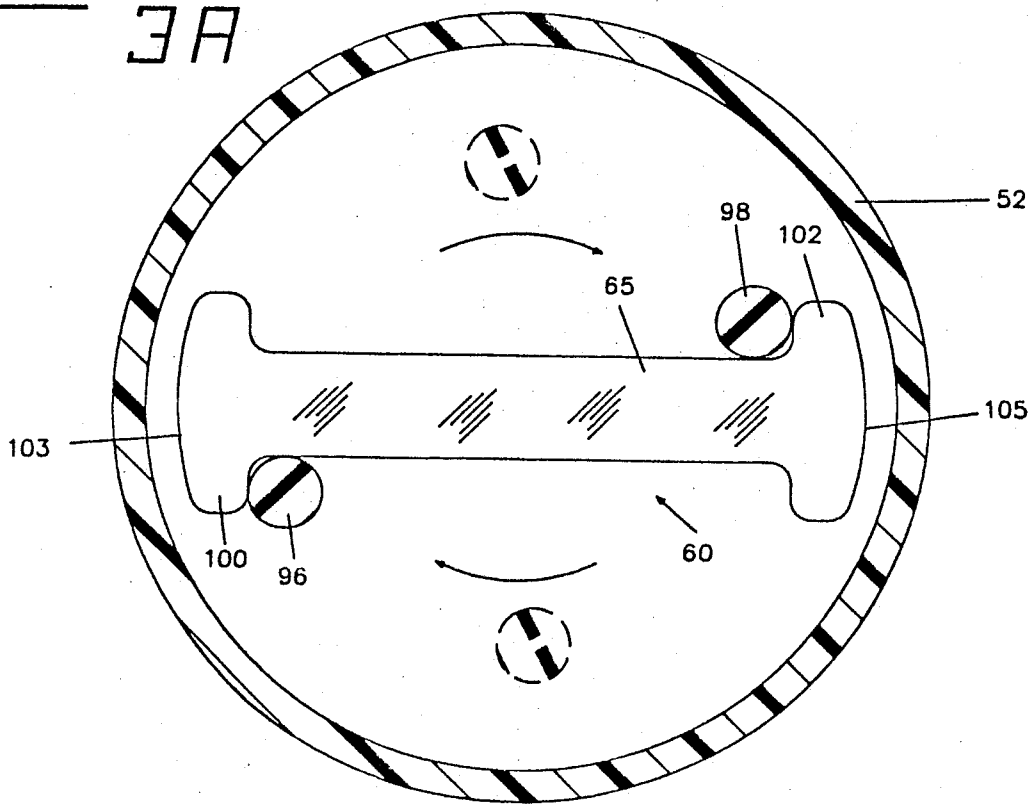
FIG. 3A is a cross section taken along IIIA—IIIA in FIG. 3.

Referring now also to FIG. 3A, a plate 94, centrally connected to crank shaft 80, terminates in first and second driver bosses 96 and 98. The opposed ends of top bar 65 include at least one tangential tab 100 and 102 facing against the direction of rotation of impeller 60. Curved ends 103 and 105 of top bar 65 are spaced closely enough to the inner surface of annular side wall 52 to permit initial misalignment of top bar 65 to be overcome.

As will be clear to one skilled in the art, impeller 60 may be placed in canister 24 with an arbitrary angular orientation with respect to circular plate 68. After less than 180 degrees of rotation of circular plate 68, driver bosses 96 and 98 are moved from their arbitrary disengaged position, shown in dashed line in FIG. 3A to their solid line position. The diameters of driver bosses 96 and 98, together with the radii on tangential tabs 100 and 102 are great enough to move top bar 65 into its centered position and thereafter to hold it there while urging impeller 60 in its rotary motion At least one, and preferably two, recesses 106 in annular wall 66 permit deflection thereinto of staked portions 108 of a lower perimeter of cover 50. This provides a rapid and secure method for installing cover 50. It will be clear from the foregoing that, once cover 50 is installed, cap 46 becomes an integral unit hingedly attached by drive arm 22 to orbit plate 16.

Figure 4:
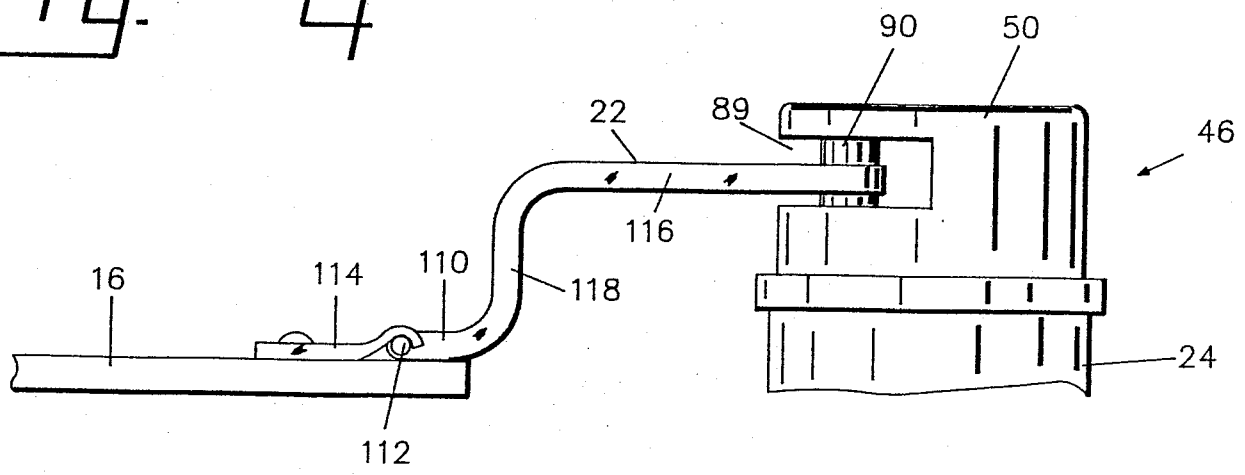
FIG. 4 is a side view of a portion of one of the tinters of FIGS. 1 and 2 with the cap in its operational position.

Referring now to FIG. 4, a side view of a portion of a single canister 24 with its cap 46 installed and connected by its drive arm 22 to orbit plate 16. Details not important to the present description are omitted. Drive arm 22 includes a lower portion 110 having a pivot shaft 112 extending from each side thereof (only pivot shaft 112 is visible in the figure). A clamp 114 secures each pivot shaft 112 to the surface of orbit plate 16. An offset portion 116 is joined to lower portion 110 by a connecting portion 118. In this way, orbital motion of orbit plate 16 is transmitted directly to crank 82 (FIG. 3).

Figure 5:
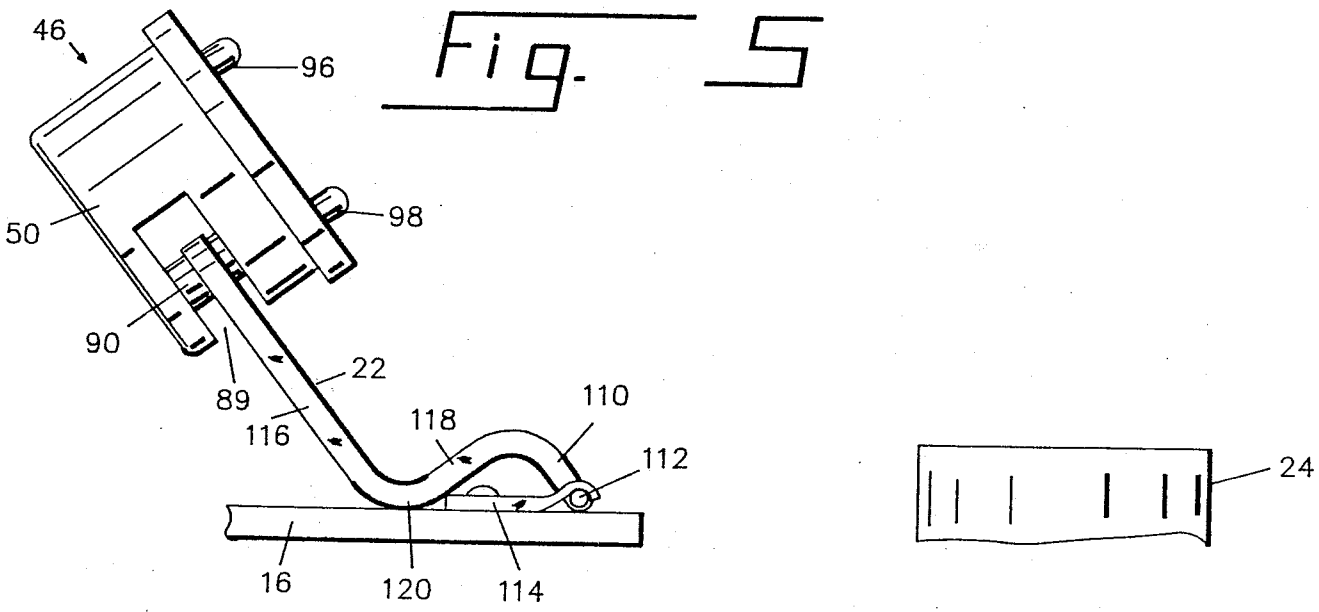
FIG. 5 is a side view corresponding to FIG. 4 with the cap hinged away from the top of its canister.

Referring now to FIG. 5, cap 46 is removed from canister 24 and hinged out of the way about pivot shaft 112 until a corner 120 joining offset portion 116 and connecting portion 118 contacts the upper surface of orbit plate 16. When this contact occurs, the center of gravity of the mass supported by pivot shaft 112 is over-center. Thus, the assembly tends to remain in the position shown, thereby clearing the top of canister 24 for filling or cleaning.

When cap 46 is again rotated onto canister 24, alignment of driver bosses 96 and 98 are not critical. If orbit plate 16 has remained stationary in the interim, driver bosses 96 and 98 will assume the same angular position they occupied when cap 46 was removed. Thus, engagement of grooves 100 in driver bosses 96 and 98 with pins 102 and 104 (FIG. 3) take place upon replacing cap 46. If orbit plate 16 has moved, driver bosses 96 and 98 will lie out of contact with driver bosses 96 and 98. However, within less than 180 degrees of orbital motion of orbit plate 16, driving contact will be established without requiring attention from an operator.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A paint tinter comprising:
said paint tinter including a canister;
an impeller within said canister;
a cap fittable onto an upper end of said canister;
said cap including an inner member having a guide centrally disposed therein;
a crank shaft rotatably fitted through said guide;
a plate affixed at a lower end of said crank shaft;
first and second means for lost-motion connection from first and second opposed ends of said plate to said impeller;
a crank affixed to an upper end of said crank shaft;
said plate and said crank shaft capturing said inner member therewith;
a drive arm;
means for connecting a first end of said drive arm to a distal end of said crank for providing rotation thereto;
means for preventing disconnection of said means for connecting, whereby said inner member, said crank and said drive arm form a unitary assembly;
means for lost-motion connection between distal ends of said plate and said impeller;
means for rotating said first end of said drive arm;
hingeable means for connecting a second end of said drive arm to said means for rotating;
said means for lost-motion connection permitting free disconnection of said plate from said impeller; and
said hingeable means including means for permitting said drive arm and said cap to be hinged as an assembly, whereby a top of said canister is exposed.

2. A paint tinter according to claim 1 wherein said hingeable means includes means for permitting said drive arm and said cap to travel over-center and means for providing a stable rest position therefor.

3. A paint tinter comprising:
said paint tinter including a canister;
an impeller within said canister;
a cap fittable onto an upper end of said canister;
said cap including an inner member having a guide centrally disposed therein;
a crank shaft rotatably fitted through said guide;
a plate affixed at a lower end of said crank shaft;
first and second means for lost-motion connection from first and second opposed ends of said plate to said impeller;
a crank affixed to an upper end of said crank shaft;
said plate and said crank shaft capturing said inner member therewith;
a drive arm;
means for connecting a first end of said drive arm to a distal end of said crank for providing rotation thereto;
means for preventing disconnection of said means for connecting, whereby said inner member, said crank and said drive arm form a unitary assembly;
means for lost-motion connection between distal ends of said plate and said impeller;
means for rotating said first end of said drive arm;
said means for preventing disconnection includes a cover over said inner member;
said cover including a window for permitting said arm to enter said cover for connection to said crank; and
said means for preventing disconnection includes an interference between said cover and a member connected to said first end of said drive arm.

4. A paint tinter according to claim 3, wherein:
said means for connecting includes a pin affixed to said first end and a hole in an outer end of said crank engaged by said pin;
said cover being disposed a predetermined distance from said first end;
said pin having a predetermined length; and
said predetermined length exceeding said predetermined distance whereby said pin is unable to disengage from said hoe while said cover is in place.

* * * * *